US010609989B2

(12) United States Patent
Sun

(10) Patent No.: US 10,609,989 B2
(45) Date of Patent: Apr. 7, 2020

(54) SAFETY BELT BUCKLE

(71) Applicant: YOKE INDUSTRIAL CORP., Taichung (TW)

(72) Inventor: Eason Sun, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 44 days.

(21) Appl. No.: 15/846,609

(22) Filed: Dec. 19, 2017

(65) Prior Publication Data

US 2019/0183212 A1 Jun. 20, 2019

(51) Int. Cl.
*A44B 11/25* (2006.01)

(52) U.S. Cl.
CPC ..... *A44B 11/2519* (2013.01); *A44B 11/2561* (2013.01); *A44B 11/2573* (2013.01)

(58) Field of Classification Search
CPC ..... A44B 11/2519; A44B 11/2561; Y10T 24/45628; Y10T 24/45702
See application file for complete search history.

(56) References Cited

U.S. PATENT DOCUMENTS 3,201,840 A * 8/1965 Jantzen ..... A44B 11/2519 24/634
3,233,300 A * 2/1966 Meeker ..... A44B 11/2526 24/637
3,605,210 A * 9/1971 Lohr ..... A44B 11/2511 24/635
4,062,091 A * 12/1977 Holmberg ..... A44B 11/2511 24/637
4,310,954 A * 1/1982 Lewis ..... A44B 11/2523 24/636
4,490,892 A * 1/1985 Ueda ..... A44B 11/2515 24/633

(Continued)

FOREIGN PATENT DOCUMENTS

CN 205321432 U 6/2016
TW M527332 U 8/2016
TW M557619 U 4/2018

OTHER PUBLICATIONS

Examination Report for TW 106138431, dated Apr. 11, 2018, Total of 6 pages.

(Continued)

*Primary Examiner* — Robert Sandy
*Assistant Examiner* — Rowland Do
(74) *Attorney, Agent, or Firm* — R. Lynette Wylie; Apex Jurls, pllc.

(57) ABSTRACT

A safety belt buckle includes a base and a latch. The base includes a chamber with at least one positioning member disposed therein, and an opening communicating with the chamber. The latch includes a tongue with at least one recess with one open side, is adapted to be inserted into the chamber through the opening. The at least one positioning member is introduced into the at least one recess through the open side thereof to be engaged with the at least one recess when the tongue is inserted into the chamber. By the design mentioned above, the latch could be engaged with the positioning member of the base through the recess. Whereby, the latch still could be engaged with the base securely and would not be released easily and accidentally when any one of the latch and the base is laterally pushed or pulled.

12 Claims, 7 Drawing Sheets

(56) References Cited

U.S. PATENT DOCUMENTS

| | | | | |
|---|---|---|---|---|
| 5,283,933 | A * | 2/1994 | Wiseman | A44B 11/2511 24/579.11 |
| 5,380,067 | A * | 1/1995 | Turvill | A44B 11/2519 24/615 |
| 5,465,472 | A * | 11/1995 | Matoba | A44B 11/266 24/625 |
| 6,965,231 | B1 * | 11/2005 | Cinoglu | A61B 5/0555 324/300 |
| 7,174,609 | B2 * | 2/2007 | Park | A44B 11/266 24/614 |
| 7,350,277 | B1 | 4/2008 | Canfield et al. | |
| 9,709,082 | B2 * | 7/2017 | Hsu | F16B 2/18 |
| 2002/0184742 | A1 * | 12/2002 | Casebolt | A44B 11/253 24/634 |
| 2006/0048350 | A1 * | 3/2006 | Coulombe | A44B 11/253 24/634 |
| 2009/0013510 | A1 * | 1/2009 | Liang | A44B 11/266 24/648 |
| 2010/0071173 | A1 * | 3/2010 | Hortnagl | A44B 11/2592 24/651 |
| 2014/0215773 | A1 * | 8/2014 | Hortnagl | A44B 11/2519 24/633 |
| 2014/0251725 | A1 * | 9/2014 | Schurian | A62B 35/0025 182/3 |
| 2015/0089777 | A1 * | 4/2015 | Hung | A44B 11/2511 24/593.1 |

OTHER PUBLICATIONS

Search Report for TW 106138431, dated Apr. 9, 2018, Total of 1 page.
English Abstract for CN205321432 (U), Total of 1 page.
English Abstract for TWM527332 (U), Total of 1 page.
English Abstract for TWM557619 (U), Total of 1 page.

* cited by examiner

SAFETY BELT BUCKLE

BACKGROUND OF THE INVENTION

1. Technical Field

The present invention is related to a safety belt buckle, and more particularly, the present invention is related to a safety belt buckle which could avoid accidental release.

2. Description of Related Art

Safety belts are commonly used in keeping people safely secured to fixtures (e.g., seats in vehicles, vessels, and amusement facilities) or safety equipment for extreme sports (e.g., sky diving) and high altitude jobs (e.g. high-rise window cleaning).

A conventional safety belt buckle includes a base and a latch which could be engaged with each other. Inside the base is disposed with a chamber which is adapted to be inserted by the latch. However, the safety belt buckle is easy to be released accidentally when one of the base or the latch is pushed or pulled by an exterior force, which results in a disadvantage of unsecure engagement and threats the safety of a user.

BRIEF SUMMARY OF THE INVENTION

In view of the above, the present invention is to provide a safety belt buckle with secure engagement which would not be released easily as being pushed or pulled by an exterior force.

To achieve the object mentioned above, the present invention provides a safety belt buckle, including a base and a latch. Wherein, the base includes a chamber with at least one positioning member disposed therein, and an opening communicating with the chamber. The latch includes a tongue with at least one recess with one open side, and is adapted to be inserted into the chamber through the opening. The at least one positioning member is introduced into the at least one recess through the open side to be engaged with the at least one recess.

The advantage of the present invention is that by the engagement between the positioning member and the recess as the tongue of the latch is inserted into the chamber of the base, the latch still could be engaged with the base securely and would not be released easily and accidentally when any one of the latch and the base is laterally pushed or pulled.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
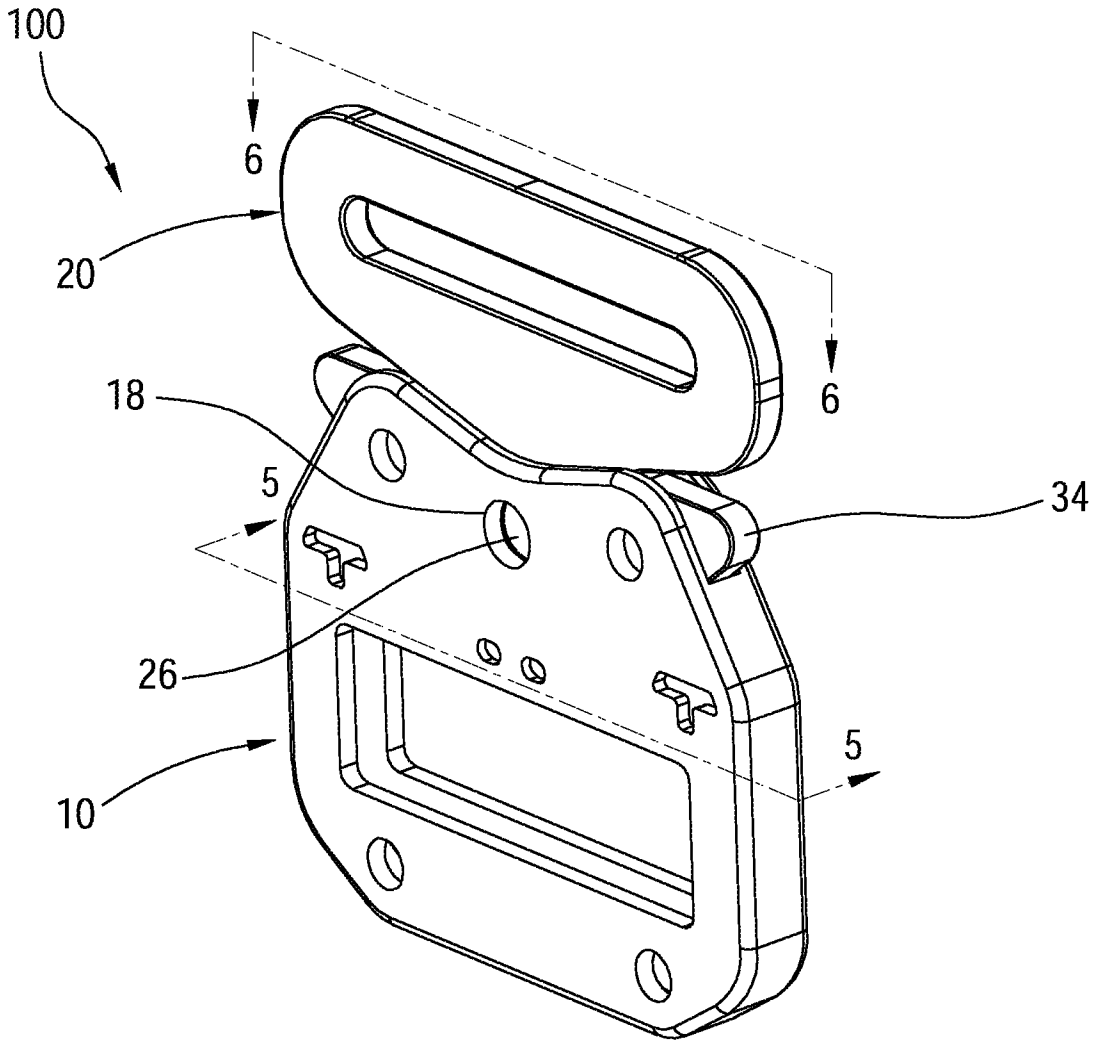
FIG. 1 is a perspective view of a safety belt buckle of an embodiment according to the present invention.
Figure 2:
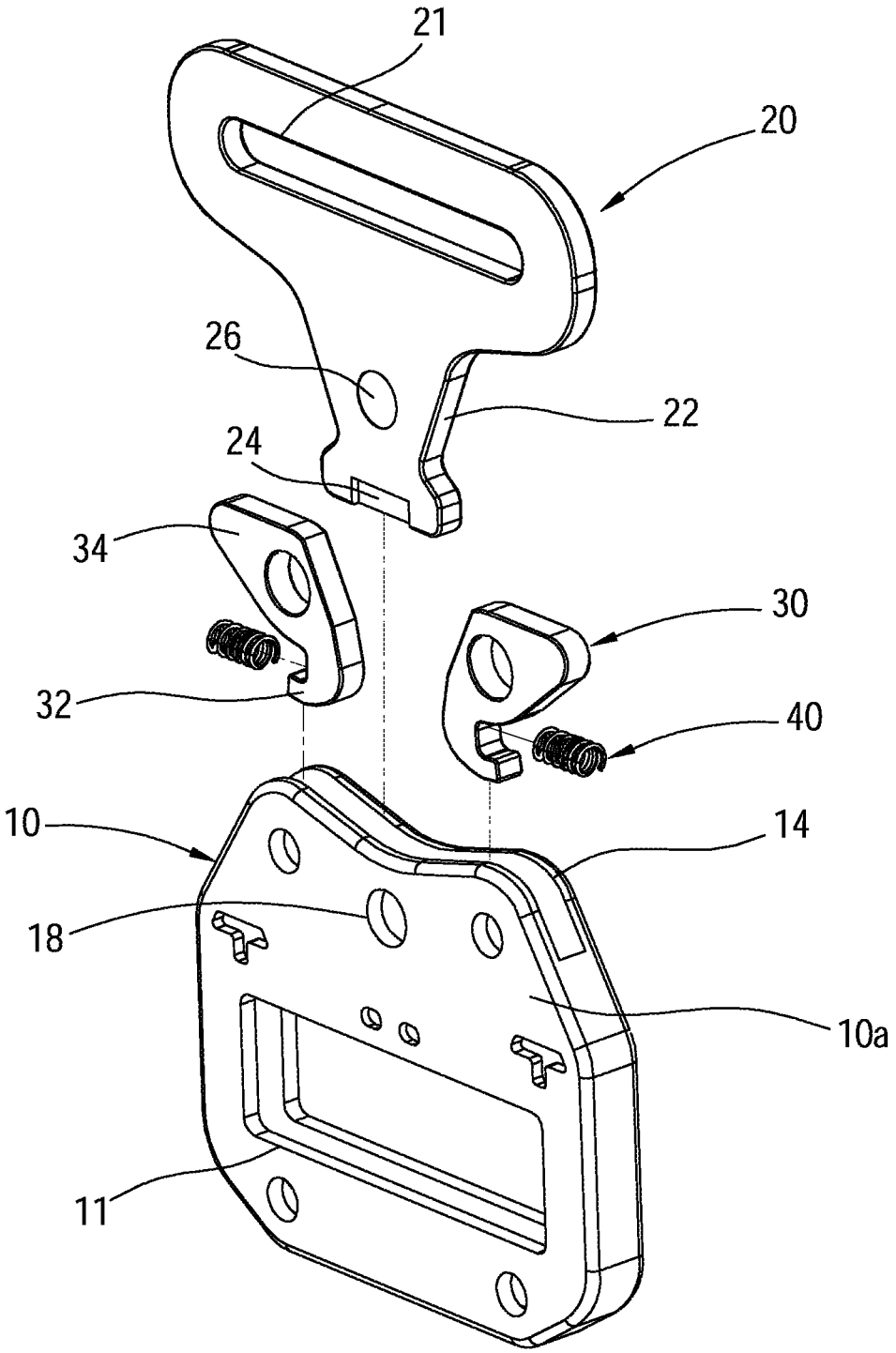
FIG. 2 is an exploded view of the safety belt buckle of FIG. 1.

The following illustrative embodiments and drawings are provided to illustrate the disclosure of the present invention, these and other advantages and effects can be clearly understood by persons skilled in the art after reading the disclosure of this specification. As shown in FIG. 1 and FIG. 2, a safety belt buckle 100 of an embodiment according to the present invention includes a base 10, a latch 20, two position limiting members 30, and two elastic members 40.

Figure 3:
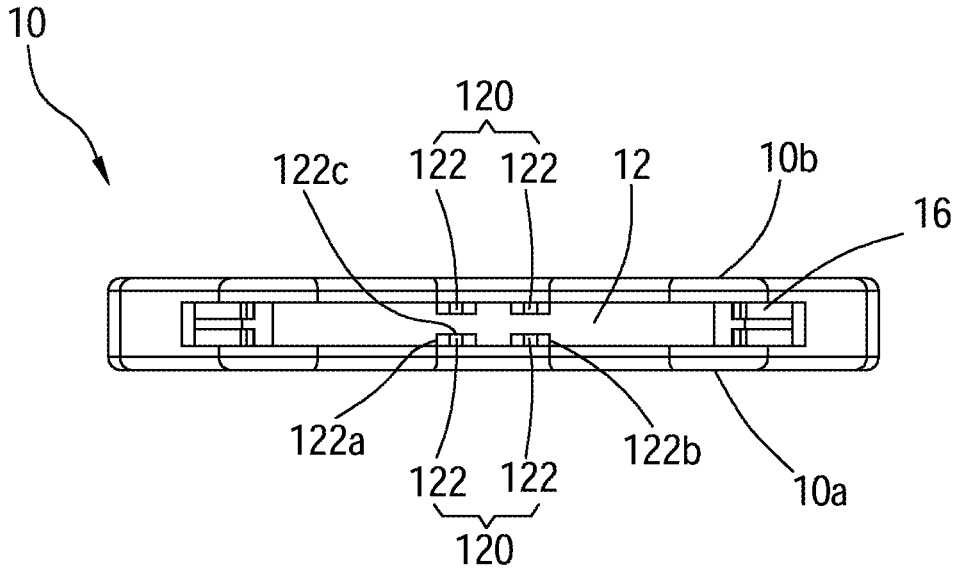
FIG. 3 is a top view of the base of the safety belt buckle of FIG. 1.

As shown in FIG. 2 and FIG. 3, the base 10 includes a connection part 11, a chamber 12, and an opening 14. The connection part 11 is adapted to connect to a seat belt. Inside of the chamber 12 is disposed with at least one positioning member 120. The opening 14 communicates with the chamber 12. Thus, the chamber 12 communicates with an exterior through the opening 14. In this embodiment, inside of the chamber 12 is disposed with two positioning members 120. The base 10 has a first surface 10*a* and a second surface 10*b* which are opposite to each other. The two positioning members 120 are formed in the chamber 12 with a shaping process by stamping the first surface 10*a* and the second surface 10*b* of the base 10 to be located respectively on two opposite sites in the chamber 12, wherein each of the two positioning members 120 has two positioning posts 122. Moreover, the amount of said positioning members 120 is not limited, i.e., not limited to two positioning members 120. In other applications, inside of the chamber 12 could be disposed with one positioning member 120. For example, the positioning member 120 is formed with a shaping process by stamping one of the first surface 10*a* or the second surface 10*b* in the chamber 12, and is not limited to the method illustrated in the above description.

Moreover, a stopper 16 could be further disposed in the chamber 12 of the base 10. In this embodiment, inside of the chamber 12 is disposed with a plurality of stoppers 16, each of which is respectively formed with a shaping process by stamping the first surface 10*a* and the second surface 10*b* of the base 10 to be protruded into the chamber 12. Wherein, the advantage of utilizing the stamping process to form the positioning member 120 and the stopper 16 is that it is convenient to proceed the processing process and favorable for mass production, which could reduce the manufacturing cost.

Figure 4:
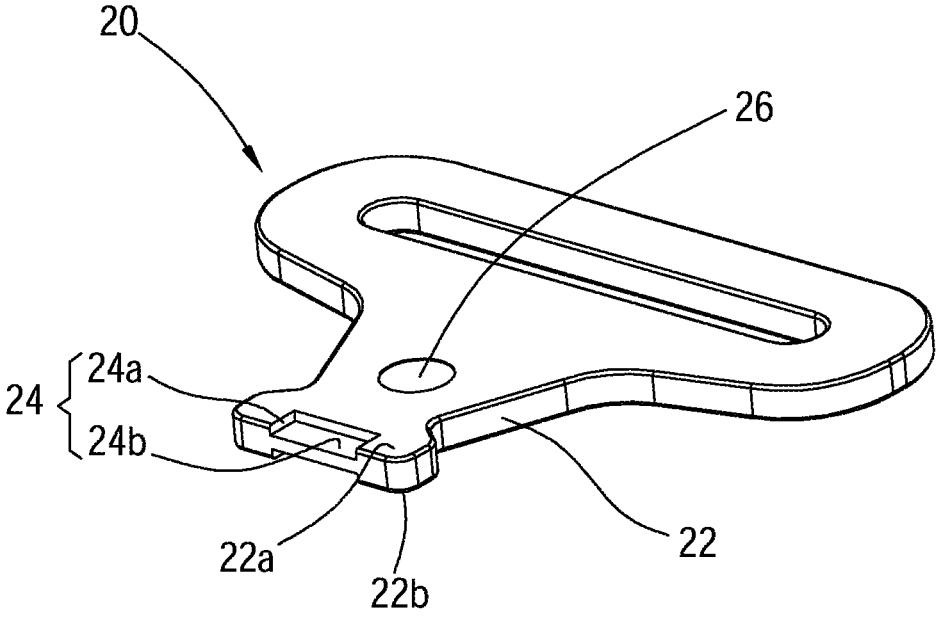
FIG. 4 is a perspective view of the latch of the safety belt buckle of FIG. 1.
Figure 5:
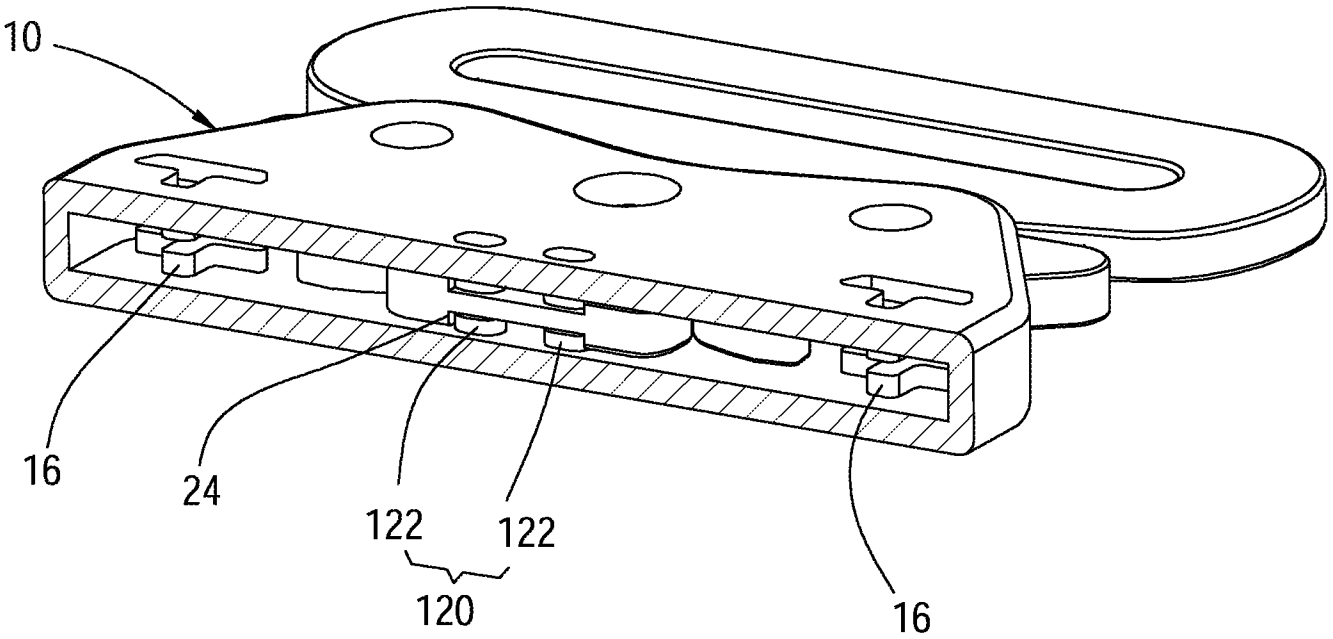
FIG. 5 is a cross-sectional view of the safety belt buckle of FIG. 1 along line 5-5 of FIG. 1.

As shown in FIG. 2 and FIG. 4, the latch 20 includes a connection part 21 and a tongue 22, wherein the connection part 21 is adapted to connect to a seat belt, and the tongue 22, which includes at least one recess 24 with an open side, is adapted to be inserted into the chamber 12 through the opening 14 of the base 10. When the tongue 22 is inserted into the chamber 12, the at least one positioning member 120 is introduced into the at least one recess 24 through the open side to be engaged with the at least one recess 24. In this embodiment, the tongue 22 has two opposite surfaces 22*a* and 22*b*, each of which includes one recess 24 respectively. The open sides of the two recesses 24 are positioned toward the same direction, such as both being positioned toward a terminal side of the tongue 22. Whereby, by utilizing the design mentioned above, as shown in FIG. 2 to FIG. 5, when the tongue 22 is inserted into the chamber 12 of the base 10, the two positioning members 120 are respectively introduced into and engaged with the two recesses 24 through the open sides of the two recesses 24. Meanwhile, each of the two positioning posts 122 of the two positioning members 120 abuts against two sidewall surfaces 24*a* of the recess 24 via side portions 122*a*, 122*b* thereof, while a top portion 122*c* of each of the two positioning posts 122 abuts against a bottom surface 24*b* of the recess 24. Whereby, it could prevent the latch 20 from over-deflecting or over-tilting corresponding to the base 10 by utilizing the engagement relation between the positioning members 120 and the recesses 24 so as to have an advantage in avoiding accidental or unexpected release to ensure secure engagement even when either one of the base 10 and the latch 20 is pushed or pulled by an exterior force after being engaged together. Moreover, it is worth mentioning that each of the side portions 122*a* of the two positioning posts 122 has a convex curved surface to abut against the sidewall surfaces 24*a* of the recess 24. By the design of the convex curved surface, the two positioning posts 122 and the sidewall surfaces 24*a* of the recess 24 of the tongue 22 could abut against and be engaged with each other more easily with the assistance of the convex curved surface.

Figure 6:
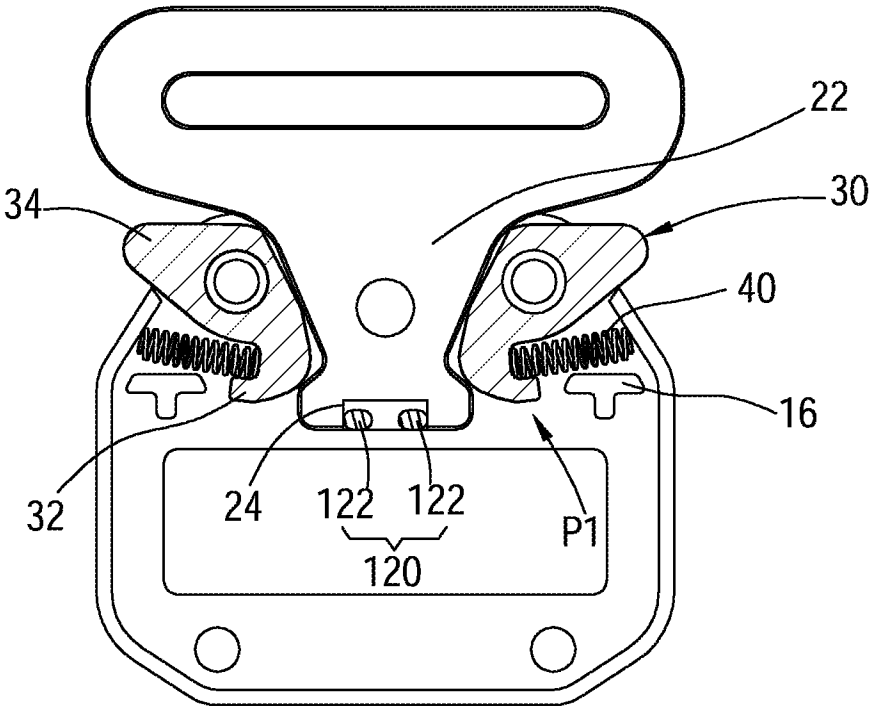
FIG. 6 and FIG. 7 are cross-sectional views of the safety belt buckle of FIG. 1 along line 6-6 of FIG. 1, showing the position limiting member being at a first position and a second position.
Figure 7:
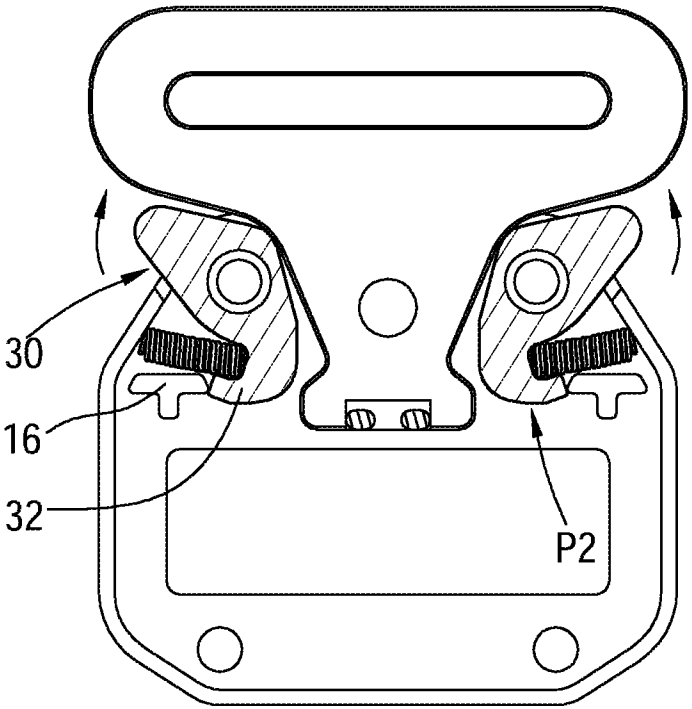

As shown in FIG. 1 to FIG. 2 and FIG. 6 to FIG. 7, the two position limiting members 30 are located in the chamber 12 of the base 10 and could be moved between a first position P1 (as shown in FIG. 6) and a second position P2 (as shown in FIG. 7). In this embodiment, the two position limiting members 30 are pivotally connected in the chamber 12 and could be pivoted between the first position P1 and the second position P2. Each of the two position limiting members 30 includes an abutting part 32 and a control part 34. The abutting part 32 is adapted to abut against the tongue 22 or the stopper 16. Furthermore, when the two position limiting members 30 are at the first position P1, each edge portion of the two abutting parts 32 of the two position limiting members 30 respectively abuts against each of the two sides of the tongue 22 of the latch 20 so as to restrict the latch 20 from being detached from the base 10. When the two position limiting members 30 are at the second position P2, the edge portions of the two abutting parts 32 of the two position limiting members 30 are apart from the tongue 22 of the latch 20, and the two abutting parts 32 abut against the stoppers 16, so that the latch 20 could be detached from the base 10.

Moreover, the two elastic members 40 are located in the chamber 12. Each of the two elastic members 40 connects the position limiting member 30 to the base 10 respectively to provide an elastic force to keep the position limiting member 30 be at the first position P1 under normal condition. In this embodiment, the elastic members 40 are springs, wherein the two ends of each of the springs connect the position limiting member 30 to the base 10 respectively. However, it is not limited thereto.

Alternatively, as shown in FIG. 1 and FIG. 2, in an embodiment, an aperture 18 is formed on the base 10 and communicates with the chamber 12, while a labelling part 26 is disposed on the tongue 22 of the latch 20. Wherein, the labelling part 26 could be exposed by the aperture 18 when the tongue 22 of the latch 20 is inserted into the chamber 12 of the base 10, so that a user could recognize whether the latch 20 and the base 10 are engaged together appropriately or not. For example, the labelling part 26 could be designed to be completely exposed by the aperture 18 when the latch 20 and the base 10 are engaged together correctly. Therefore, when the user notices that the labelling part 26 is not totally exposed by the aperture 18, which means that the latch 20 and the base 10 are not engaged together completely, it is necessary for the user to fasten the latch 20 and the base 10 again so as to improve the security of the safety belt buckle. Alternatively, in other applications, the labelling part 26 is not limited to be completely exposed by the aperture 18 and could be designed as having several sections which represent different meanings such as complete engagement or uncompleted engagement which requires reengaging the latch 20 and the base 10 together again, etc.

Figure 8:
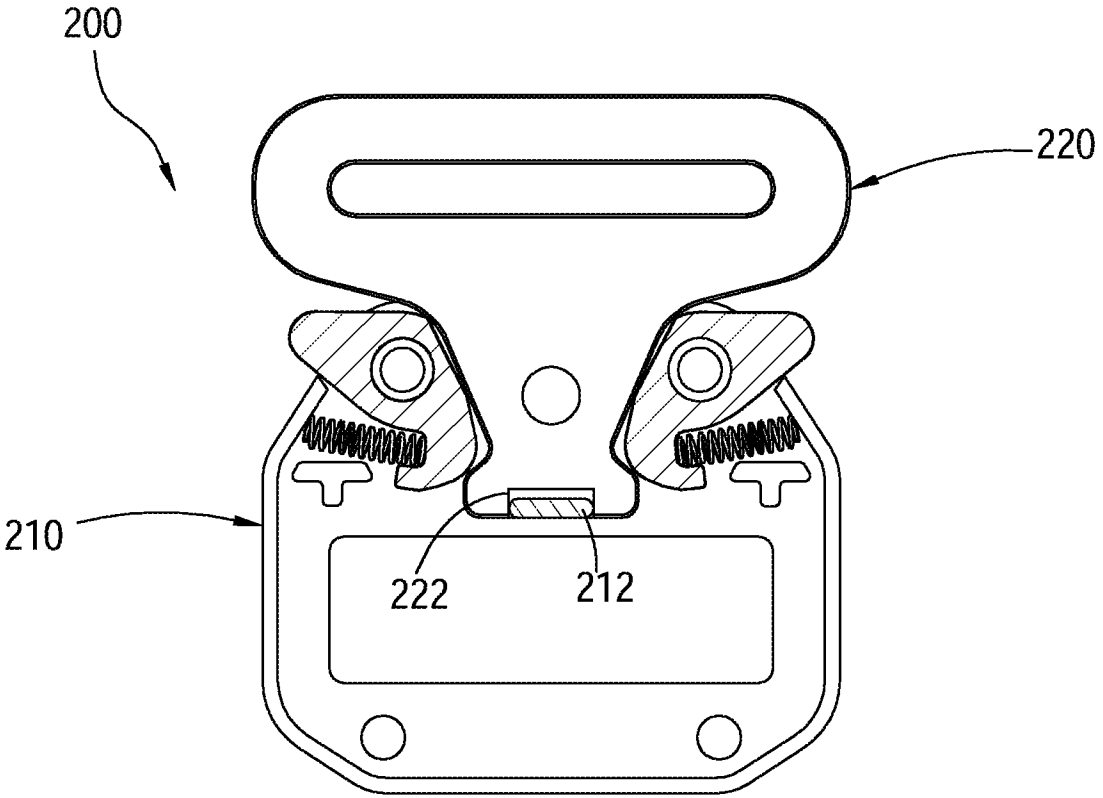
FIG. 8 is a cross-sectional view of a safety belt buckle of another embodiment according to the present invention, showing a base of the safety buckle having a positioning member of a different type.

As shown in FIG. 8, a safety belt buckle 200 of another embodiment according to the present invention has almost the same structure as the safety belt buckle 100 of the embodiment mentioned above, except that a positioning member 212 of a base 210 of the safety belt buckle 200 is rod-shaped, wherein a top portion of the positioning member 212 could abut against a bottom surface of a recess 222 of a latch 220, and two side portions of the positioning member 212 could be adapted to abut against two sidewall surfaces of the recess 222 respectively to provide the advantage of secure engagement. Furthermore, the two side portions of the positioning member 212 could be designed with convex curved surfaces to abut against the two sidewall surfaces of the recess 222, which is favorable for the positioning member 212 to slide into or out of the recess 222 when the base 210 and the latch 220 are to be engaged together or detached from each other.

Figure 9:
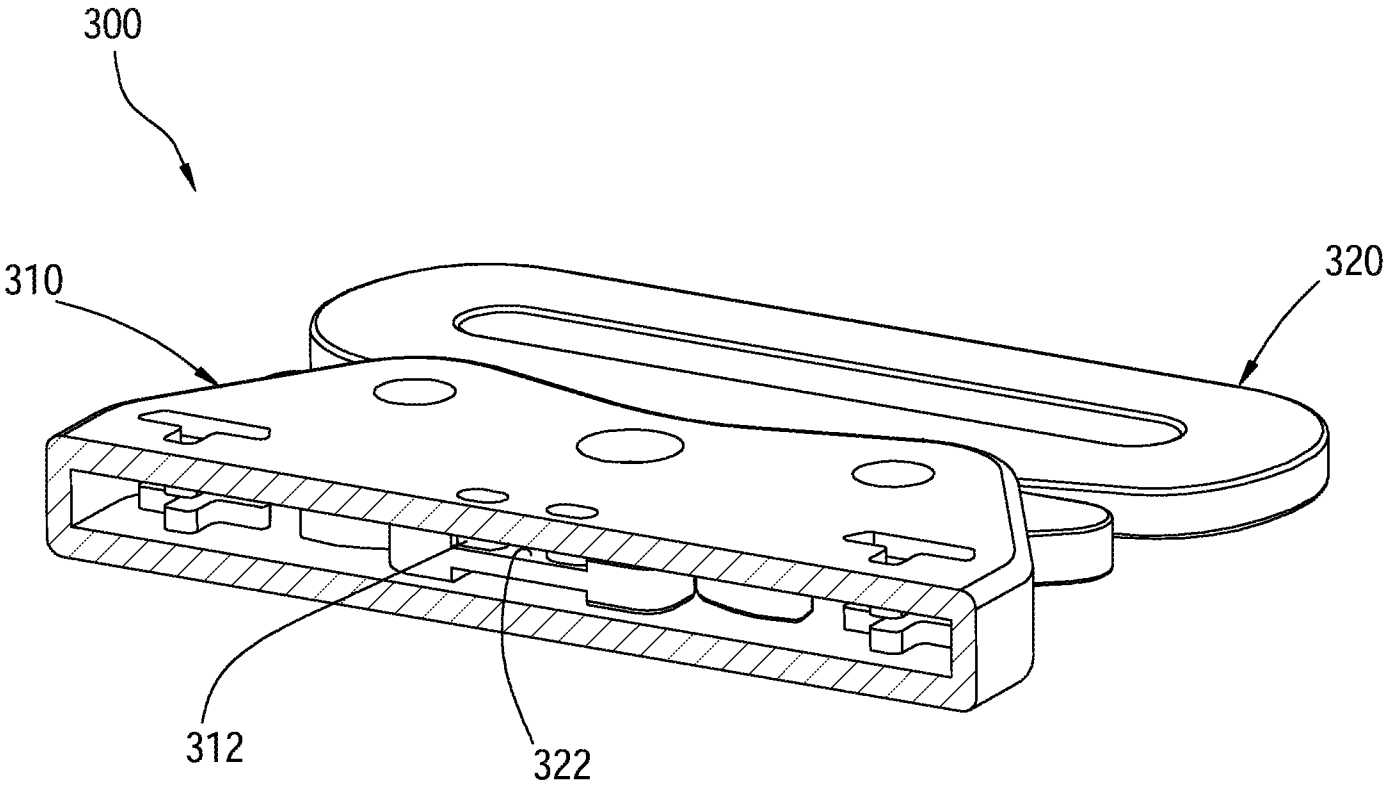
FIG. 9 is a cross-sectional view of a safety belt buckle of another embodiment according to the present invention, showing the safety belt buckle having a base of a different type.

As shown in FIG. 9, a safety belt buckle 300 of another embodiment according to the present invention has almost the same structure as the safety belt buckle 100 of the embodiment mentioned above, except that inside of a chamber of a base 310, only one side surface is disposed with at least one positioning member 312, which is adapted to be engaged with an arbitrary recess 322 on either side of a latch 320. That is, it is not limited to the aforementioned embodiments which have positioning members being disposed on two opposite sites in the chamber.

It must be pointed out that the embodiments described above are only some embodiments of the present invention. All equivalent structures which employ the concepts disclosed in this specification and the appended claims should fall within the scope of the present invention.

What is claimed is:

1. A safety belt buckle, comprising:

a base, including a chamber and an opening, wherein the chamber is disposed with at least one positioning member therein, and the opening communicates with the chamber; and a latch, including a tongue with at least one recess and adapted to be inserted into the chamber through the opening, wherein the at least one recess has an open side; the at least one positioning member is introduced into the at least one recess through the open side to be engaged with the at least one recess;

wherein when the tongue is located in the chamber and an exterior force is exerted from a lateral direction with respect to an inserting direction of the latch, the latch tilts with respect to the base so far as the at least one positioning member abuts against a lateral surface of the at least one recess;

wherein the at least one positioning member integrally protrudes from an inner surface of the chamber of the base;

wherein the tongue has two opposite surfaces, each of which includes one recess respectively; the open sides of the two recesses are positioned toward the same direction;

wherein inside of the chamber is disposed with two positioning members which are located respectively on two opposite sites in the chamber; the two positioning members are respectively introduced into and engaged with the two recesses when the tongue is inserted into the chamber.

2. The safety belt buckle of claim 1, wherein a top portion of the at least one positioning member is adapted to abut against a bottom surface of the at least one recess.

3. The safety belt buckle of claim 2, wherein a side portion of the at least one positioning member is adapted to abut against a sidewall surface of the at least one recess.

4. The safety belt buckle of claim 3, wherein the side portion has a convex curved surface which is adapted to abut against the sidewall surface of the at least one recess.

5. The safety belt buckle of claim 1, wherein a side portion of the at least one positioning member is adapted to abut against a sidewall surface of the at least one recess.

6. The safety belt buckle of claim 5, wherein the side portion has a convex curved surface which is adapted to abut against the sidewall surface of the at least one recess.

7. The safety belt buckle of claim 1, wherein the at least one positioning member is formed by stamping the base.

8. The safety belt buckle of claim 1, wherein the base includes an aperture which communicates with the chamber; the tongue of the latch includes a labelling part which could be exposed by the aperture when the tongue is inserted into the chamber.

9. The safety belt buckle of claim 1, wherein the safety belt buckle further comprises a position limiting member located in the chamber of the base, which could be moved between a first position and a second position, and a stopper disposed inside of the chamber of the base; when the position limiting member is at the first position, an edge portion of the position limiting member abuts against the latch so as to restrict the latch from being detached from the base; when the position limiting member is at the second position, the edge portion of the position limiting member is apart from the latch so that the latch could be detached from the base.

10. The safety belt buckle of claim 9, wherein the stopper is formed by stamping the base.

11. A safety belt buckle, comprising:

a base, including a chamber and an opening, wherein the chamber is disposed with at least one positioning member therein, and the opening communicates with the chamber; and a latch, including a tongue with at least one recess and adapted to be inserted into the chamber through the opening, wherein the at least one recess has an open side; the at least one positioning member is introduced into the at least one recess through the open side to be engaged with the at least one recess;

wherein when the tongue is located in the chamber and an exterior force is exerted from a lateral direction with respect to an inserting direction of the latch, the latch tilts with respect to the base so far as the at least one positioning member abuts against a lateral surface of the at least one recess;

wherein the at least one positioning member integrally protrudes from an inner surface of the chamber of the base;

wherein the at least one positioning member includes two positioning posts which are respectively adapted to abut against two sidewall surfaces of the at least one recess via two side portions thereof.

12. A safety belt buckle, comprising:

a base, including a chamber and an opening, wherein the chamber is disposed with at least one positioning member therein, and the opening communicates with the chamber; and a latch, including a tongue with at least one recess and adapted to be inserted into the chamber through the opening, wherein the at least one recess has an open side; the at least one positioning member is introduced into the at least one recess through the open side to be engaged with the at least one recess;

wherein when the tongue is located in the chamber and an exterior force is exerted from a lateral direction with respect to an inserting direction of the latch, the latch tilts with respect to the base so far as the at least one positioning member abuts against a lateral surface of the at least one recess;

wherein an end of the at least one positioning member integrally protrudes from an inner surface of the chamber of the base, and another end of the at least one positioning member is a free end which does not contact with the inner surface of the chamber of the base;

wherein the tongue has two opposite surfaces facing opposite directions; at least one of the two opposite surfaces of the tongue has the at least one recess which does not penetrate through the two opposite surfaces of the tongue.

* * * * *